United States Patent [19]

Wendt

[11] Patent Number: 4,621,473

[45] Date of Patent: Nov. 11, 1986

[54] FIELD ATTACHMENT CLIP FOR WALL PANELS

[75] Inventor: Alan C. Wendt, Barrington, Ill.

[73] Assignee: United States Gypsum Company, Chicago, Ill.

[21] Appl. No.: 519,850

[22] Filed: Aug. 3, 1983

[51] Int. Cl.[4] ..... E04B 1/38

[52] U.S. Cl. ..... 52/489; 52/361; 52/481; 52/714

[58] Field of Search ..... 52/357, 359, 360, 361, 52/481, 483, 489, 508, 509, 543, 553, 667, 677, 714, 715, 580, 582, 583, 587, DIG. 6; 24/543, 563

[56] References Cited

U.S. PATENT DOCUMENTS

| | | | |
|---|---|---|---|
| 1,998,049 | 4/1935 | Fulton | 52/DIG. 6 |
| 2,200,649 | 5/1940 | Wardle | 52/DIG. 6 |
| 2,258,574 | 10/1941 | Leary | 52/285 |
| 2,282,624 | 5/1942 | Upson et al. | 52/361 |
| 2,282,631 | 5/1942 | Winship | 52/361 |
| 2,851,740 | 9/1958 | Baker | 52/489 |
| 2,880,481 | 4/1959 | Robinson | 52/582 |
| 3,020,602 | 2/1962 | Siering | 52/489 |
| 3,413,772 | 12/1968 | McCarthy | 52/677 |
| 3,553,919 | 1/1971 | Omholt | 52/489 |
| 3,711,137 | 1/1973 | Tinnerman | 52/714 |
| 4,263,764 | 4/1981 | Wendt | 52/481 |
| 4,377,060 | 3/1983 | Ragland | 52/481 |

FOREIGN PATENT DOCUMENTS

| | | | |
|---|---|---|---|
| 1059286 | 7/1979 | Canada | 52/489 |
| 1364686 | 5/1969 | France | 52/489 |
| 596993 | 8/1959 | Italy | 52/483 |

*Primary Examiner*—John E. Murtagh
*Assistant Examiner*—Andrew Joseph Rudy
*Attorney, Agent, or Firm*—Samuel Kurlandsky; Robert M. Didrick; Robert H. Robinson

[57] ABSTRACT

An integral clip for attaching wall panels to metal studs having flanges in engagement with the occluded surfaces of the wall panels, the clip comprising impaling points adapted to be driven into the occluded surface of the panel for securing the clip to the panel, the clip also having flange attachment members struck from the clip and adapted to engage the flange of a stud, thereby affixing the panel to the stud.

8 Claims, 11 Drawing Figures

FIELD ATTACHMENT CLIP FOR WALL PANELS

BACKGROUND OF THE INVENTION (1) Field of the Invention

The present invention relates to building construction and more particularly concerns a perimeter or partition wall construction wherein wall panels are engaged by substantially identical and interchangeable panel clips, and having integral means for being engaged with "H" shaped studs or "Z" splines having an engageable flange.

(2) Description of the Prior Art

The installation of gypsum, veneered gypsum, wood fiber or mineral fiber panels to the interior of perimeter, i.e., external and generally load-bearing walls is a widely used method of construction in residential, commercial and industrial applications to confer decorative esthetic or functional insulative properties upon the perimeter wall. Generally, the perimeter wall is composed of concrete, brick or other masonry precluding the direct attachment of a wall panel thereto; the desirability of installing vapor barrier or insulative materials between the wall panel and the perimeter wall, taken together with the difficulty in attaching the wall panel directly to the perimeter wall, have resulted in the industry-accepted construction comprising the first attachment of furring or studding by means of nailing or screwing the wall panels into surfaces of those supports subjacent the wall panels. With the appearance of perimeter wall systems of all types, the affixation of wall panels to subjacent supports by nail or screw attachment, followed by taping or plastering the abutting edges of the panels to conceal the nail or screw holes, has found less acceptance in the marketplace.

In attempts to obviate screw or nail attachment of panels to their support members in perimeter wall construction systems comprising unfinished, i.e., nondecorative, wall boards or gypsum boards and the taping or plastering attendant thereto, and to allow the attachment of veneered or pre-finished, i.e., decorative, wall boards or gypsum boards without unsightly fastener holes or material to cover those holes, many partition and perimeter wall construction systems utilize various studs, shims, clips and wall panel edge configurations in various combinations, and other components, to facilitate the installation of such perimeter wall panels without causing damage to abutting edges of the panels of the wall system. In providing for such convenient installation, many such systems require specially formed studs for the adaptive engagement of similarly specially formed panel engaging clips. Such studs have typically required particular openings or marginal or flange elements adapted for use, in turn, with particularly shaped clips. Other systems use conventional "I"-shaped or "J"-shaped studs or "Z"-shaped splines or channel-shaped studs, and provide for the facile installation of panels thereon through the use of clips fixedly engageable with the wall panel and with the stud or spline. These systems provide the sought for ease of installation, but such clips known in the prior art, when fixedly attached to the wall panel by the impalement of tines or prongs thereinto, often give rise to a major problem commonly known in the construction art as "pooching", i.e., an abnormal protrusion or distension or swelling of one or both of the covering or laminar layers of the wall panel. This defect takes the form of a blister or bubble in the exterior laminar layer caused either by the impaling tines diverging toward either surface of the panel or by the fracture or comminution and displacement toward the covering or laminar layer of the material of construction of the wall panel by the impaling tines or prongs. This problem is especially acute in veneered or pre-finished, i.e., decorative, wall panels, since no means exist to repair such a "pooching" defect when it occurs in the veneered or pre-finished decorative interior surface or laminar layer.

SUMMARY OF THE INVENTION

It is accordingly an object of the present invention to provide an economical and facile mounting system for such wall panels in both perimeter and partition wall construction which affords positive panel placement on the wall without destruction of, or damage to, any of the wall panel elements.

It is also an object of the invention to provide a wall mounting system wherein the panel mounting clips are especially adapted for field mounting, but may also be used at either edge of the panel in mounting to subjacent support.

It is still further an object to provide an easily installed wall system wherein the defect of "pooching" does not occur.

Other objects and advantages of the invention will become apparent upon reference to the description below and to the drawings.

According to the invention, a perimeter or partition wall construction is provided in which the surface defect of "pooching" is eliminated and which comprises in combination a parallel aligned row of wall panels, adjoining panels meeting at the joints along marginal edges thereof. "Z"-shaped splines fixedly attached to the perimeter wall or "H"-shaped flanged studs are disposed subjacent to the joints. Attachment clips provide for field engagement or edge engagement of the wall panels to the flanged surface subjacent and parallel to the occluded surface of the wall panels. The clip comprises, in its basic structure, an essentially planar portion adapted to be positioned in immediate juxtaposition to the occluded surface of the panel and located for engagement to the flanged stud or spline. The clip further comprises stud flange attachment means comprising attachment members integral with the planar portion and extending therefrom, the attachment members being generally doubly arcuately formed in first being arcuately upwardly proximal the planar portion and arcuately downwardly distal to the planar portion, the proximate arcuation being substantially greater in radius than the distal arcuation. As a result the stud flange attachment means are formed to receptively frictionally engage the stud flange. The clip further comprises fingers extending at obtuse angles from two edges of the planar surface having impaling points extending at an acute angle from the ends of the fingers. As a result, after driving or finishing the impaling points into the occluded surface of the wall panel, a configuration results wherein the impaling points are driven into the surface of the panel at an angle and cooperate to grip the panel. In driving or finishing the impaling points into the occluded surface of the wall panel, minimal disrupture, fracture and displacement of the material of composition of the wall panel occurs; "pooching" or the creation of undesirable surface distensions is totally obviated. Additionally an impaling point may be struck from the planar portion of the clip to prevent lateral movement.

The objects and goals of this invention are further attained by providing an attachment clip as disclosed herein which will function properly in the economic and facile installation of wall panels of gypsum, veneered gypsum, wood fiber or mineral fiber from three-eights of an inch to one inch thick; typically. Two or more of these clips are applied to each panel when securing the panels to the subjacent flange of the "I"-, "J"-, or "Z"-shaped stud or spline when the studs or splines are installed in vertical array twelve to thirty inches on center.

DESCRIPTION OF THE PREFERRED EMBODIMENTS

Figure 1:
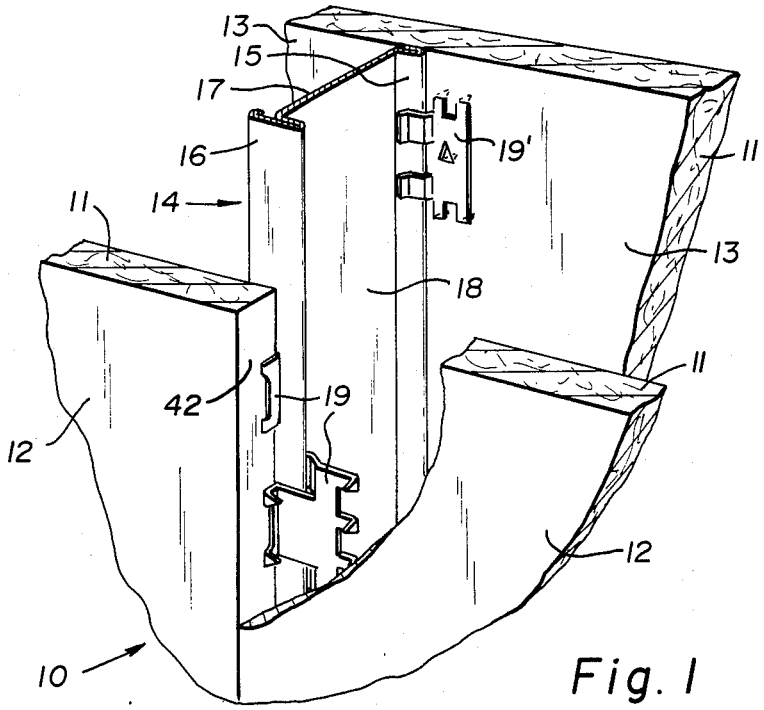
FIG. 1 is a perspective view of a portion of a hollow-wall partition construction with two panels at a joint, with a "J"-stud subjacent thereto.

Referring to FIG. 1, a typical partition wall 10 is shown at the joint location partially broken away to illustrate an embodiment of the invention. Partition wall 10 comprises two spaced-apart rows of panels 11 having exterior surfaces 12 providing the exposed or finished surfaces of the panels at the room side of the partition wall, and having interior or occluded surfaces 13 as shown on the opposite side of the panels 11 in the hollow portion of the partition wall 10. At the typical joint shown in FIG. 1, studs 14 are provided in a generally "J"-shaped configuration. Single and double flanges 15 and 16, respectively, reside subjacent to and parallel with the intermediate portion and the edge portion, respectively, of interior surfaces 13 and terminate in free ends 17. Single and double flanges 15 and 16 are integrally connected by a web 18.

Figure 3:
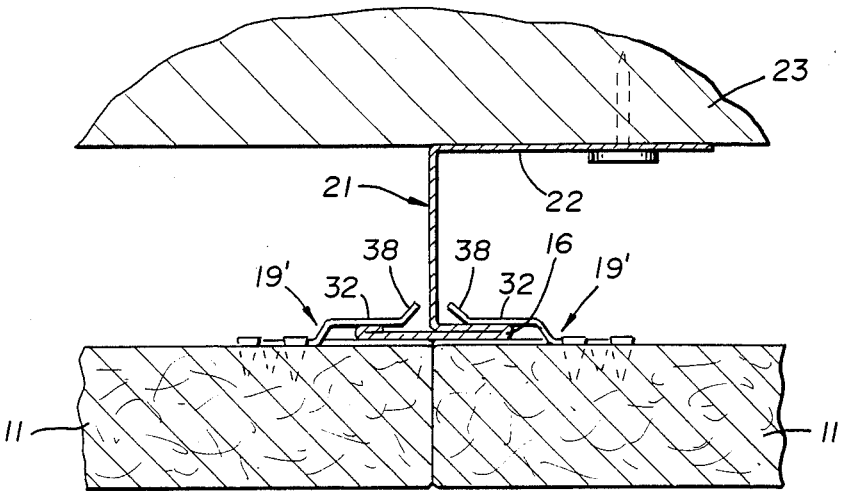
FIG. 3 is a top section view of the perimeter wall construction taken at the line 3—3 of FIG. 2, looking in the direction of the arrows.
Figure 4:
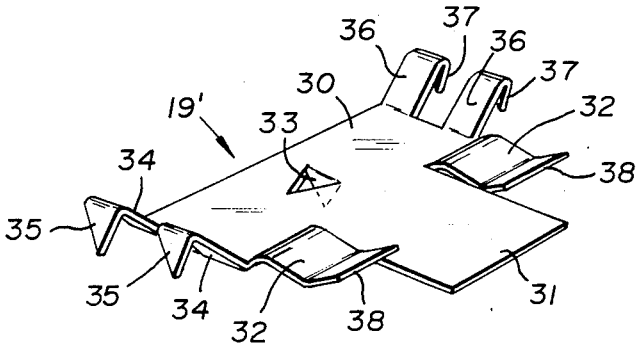
FIG. 4 is a perspective view of the panel field stud clip of the invention in the bare or uninstalled position.
Figure 5:
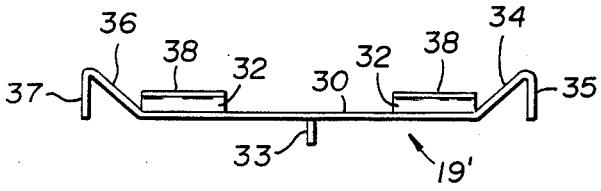
FIG. 5 is an elevational view of the field clip of the invention, showing the impaling points adapted for impalement into the occluded wall board surface in the bare or uninstalled position.
Figure 6:
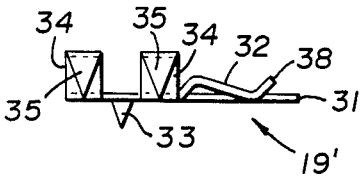
FIG. 6 is a side elevational view of the field clip of the invention in the bare or uninstalled position.
Figure 7:
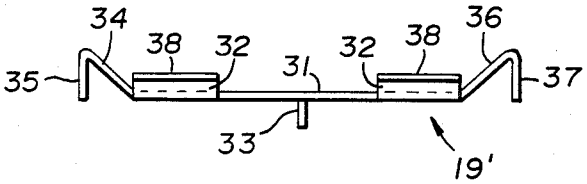
FIG. 7 is an elevational view of the field clip of the invention opposite that shown in FIG. 5.
Figure 8:
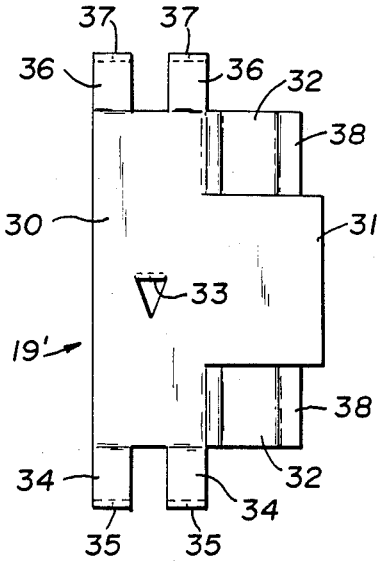
FIG. 8 is a top plan view of the field clip of the invention in the bare or uninstalled position.

Attached to the interior or occluded surface 13 of panels 11, panel stud edge clips 19 are shown in the installed or finished position engaging panels 11 to double stud flange 16. The edge clips 19 are the subject matter of a concurrently filed application by the present inventor. Erection of partition wall 10 is first commenced by impaling with a smart hammer blow the first impaling points 31 of stud edge clip 19, i.e., those impaling points parallel to the planar portion 30 of the clip, into the vertical edges 42 of a panel to be installed therein, while insuring that the planar portion 30 of the clip 19 (FIGS. 3 and 4) is in immediate juxtaposition to the occluded surface 13 of wall panel 11. Next, the second impaling points 33 of clip 19 are impaled into the occluded surface 13 of panel 11 to provide the entire fixed attachment of clip 19 to wall panel 11. At least two of the stud attachment clips are required per vertical edge. The actual number of clips 19 to be applied to each vertical edge will, of course, be a function of the height, weight and material composition of the wall panel, as well as the spacing of studs 14 on-center, and will be well within the skill and knowledge of one skilled in the wall construction art. Having provided a predetermined number of stud clips at predetermined intervals along each such vertical edge, the number of clips installed being a function of the weight and bulk of the panel 11, a first panel is then horizontally slidably engaged with the first stud flange 16 received by arcuate attachment members of clip 19 thereupon (FIG. 3). In order to provide each panel 11 with the subjacent support of more than one "J"-shaped stud, field or intermediate attachments clips 19' according to the invention are used to engage flange 15 of stud 14. Clips 19' may be attached at appropriate intervals upon the occluded surface 13 of the first panel in opposed parallel array not having double flange 16 of sheet 14 subjacent an edge thereof along the dimension on-center between adjacent "J"-shaped studs. With the secure engagement of the clips 19 placed at the edge of the panels with the flanges of the studs positioned at the ends of the panels, and the placement of the intermediate or field clips 19' engaging field-positioned studs, the panels are securely affixed to the studs upon sliding movement of the panel. The clips 19' are designed for attaching the field or middle portion of a panel to the flange of a stud, but may also be used to attach the edges of panels to stud flanges. The remaining unattached edge of panel 12 may then be fixedly secured in the perimeter wall to a subjacent stud by now placing that stud into vertial position thereby engaging a trailing edge of flange 16 of sheet 14 with the arcuate clip portion of the stud clips previously affixed to that remaining panel edge. The major characterizing feature of this invention is the ease of installation of individual panels in a wall array.

Figure 2:
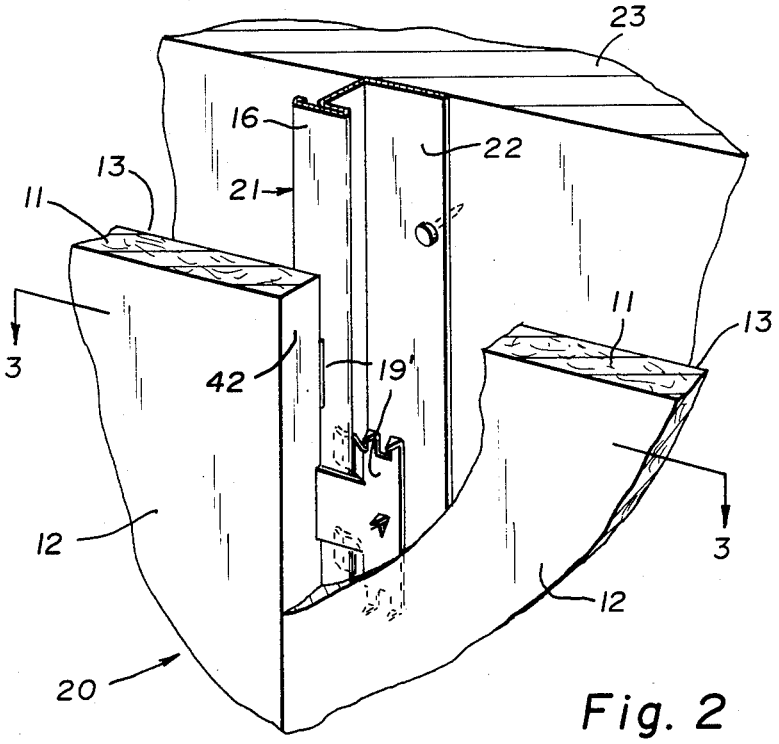
FIG. 2 is a perspective view of a portion of a perimeter wall construction having two panels at a joint with a "Z"-spline flange subjacent thereto.

Referring to FIG. 2, a typical perimeter wall is shown at a panel joint location partially broken away to illustrate the preferred embodiment of the invention. Perimeter wall 20 comprises a single row of panels 11 having exterior surfaces 12 providing the exposed area toward the room side and having interior or occluded surfaces 13 facing the perimeter wall generally composed of concrete, brick or other masonry, or less commonly, a wooden exterior wall. FIG. 2, shows a stud flange field clip 19' in demountable and relocatable assembly upon flange 16 of "Z"-shaped stud 21, which is in turn fixedly attached to the perimeter wall generally by attachment means which pierce both perimeter wall flange 22 and the perimeter wall. Although not illustrated in FIG. 2, an "H"-shaped stud may be used as subjacent support for panels 11 with like effect, although with less attention to economy of installation. Whether provided in a "Z"-shaped or as an "H"-shaped subjacent support stud, stud 21 is provided with flanges 16 and 22 parallel to the perimeter wall and to the wall panel, the former being immediately subjacent to wall panels 11 and the latter being in immediate juxtaposition to perimeter wall 23. The erection of perimeter wall 20 is similar to, and somewhat simpler than, the assembly of a partition wall 10 in FIG. 1 and is undertaken as described in FIG. 1. That is, when only attachment clips 19′ at an edge need be used, either the dimensions, weight or bulk of panels 11 indicating no need for attachment to other than subjacent studs at the edge thereof, then clips 19′ are attached at appropriate intervals to the edge 42 of panels 11, the planar portion 30 of each clip being in immediate juxtaposition with the occluded surface 13 of the panels, and the impaling points 35 being driven into the panel face, impaling the points therein. Assembly may now be affected by slidably engaging the arcuate flange attachment portion 32 of the clips onto the leading flange 16 of a first stud, attaching the other edge similarly furnished with completely impaled clips by first slidably engaging the trailing edge of a flange of a second stud 21 with the flange attachment means of the clips and then secondly fixedly attaching the second stud to the perimeter wall. Should the dimensions, weight or bulk of panel 11 indicate that edge support alone would be inadequate and that adjacent support studs intermediate the edge studs would be required for adequate support, then additional intermediate attachment of field clips 19′ may be fixed in vertical array upon the occluded surface of panel 11 spaced-apart from the on-center dimension of the spacing between the intermediate studs.

Referring to FIG. 3 there is illustrated in top sectional view the use of stud panel attachment field clips 19′ in the furring embodiment shown in perspective in FIG. 2. The panel field attachment clips 19′ are shown in finished or driven condition, impaled into the occluded surface 13 of adjacent panels 11. FIG. 3 further illustrates the ease of demounting and reinstalling individual panels 11 from subjacent studs 21; the application of vertical force to panels 11, that is, force seen as applied upwardly and perpendicularly to the plane of the drawing, will allow for the ready demounting of panels 11 from studs 21 when panels 11 and studs 21 are less than one half the floor to ceiling height of the wall upon which they are installed.

Referring to FIGS. 4–8, the field attachment clip 19′ is shown comprising a planar portion 30 including a tongue 31. Struck from the planar portion are stud attachment clip members 32 having upturned ends 38 for facilitating engagement of stud flanges 16. An impaling point 33 is struck out from the planar portion 30 for preventing lateral movement of the clip when the impaling points are being driven into a wall panel. At the edges of the planar portion 30 on each side thereof are a first set of fingers 34 and a second set of fingers 36 disposed at an obtuse angle with respect to the planar portion 30. At the ends of the fingers 34 are impaling points 35, and at the end of the fingers 36 are impaling points 37. The impaling points are disposed at an acute angle with respect to the respective fingers.

In mounting a panel, if edge clips 19 are utilized, the edge impaling points are first driven into the edge of the panel. The remaining impaling points are then driven into the occluded face of the panel. The field clips 19′ of the present invention are mounted on the occluded face of the panel by first driving in the impaling point 33 into the face of the occluded panel by means of a hammer. Then the impaling points 35 and 37 are driven into the panel surface. When the impaling points are completely driven into the panel, the fingers 34 and 36 becomes substantially parallel with the surface of the panel. After the impaling points 35 and 37 have been driven into the panel, since they are disposed at an acute angle with respect to the fingers, the impaling points on one side of the clip converge toward the impaling clips on the other side of the clips, thereby providing a gripping force which secures the clips strongly to the panel. To mount the panel it is slid toward the flanges of the supporting stud until the flanges are engaged by the clip members 32, causing the panel to be strongly affixed to the stud. When panels 11 are thus installed in perimeter panel wall 20, interior or occluded surface 13, and most particular exterior surface 12, that surface facing the interior of room, remain free of the surface delamination known in the art as "pooching", which is the formation of a blister or bubble in the laminar layers of surfaces 12 and 13 caused either by the impaling tines or prongs of prior art clips diverging toward either surface 12 or 13 of panel 11 upon impalement into the edge thereof, or by the fracture or disrupture and displacement toward the laminar layers of surfaces 12 or 13 of the material of construction of the wall panel by the impaling points.

Referring to FIGS. 5, 6, 7 and 8, there are shown, respectively, an elevational view from the proximal aspect of the occluded surface impaling points, a side elevational view, and elevational view from the proximal aspect, and a plan view of the top of clip 19′. The views, taken together, further illustrate the advantages and the freedom from the disadvantages of the prior art of the panel mounting clip 19′ of this invention.

Figure 9:
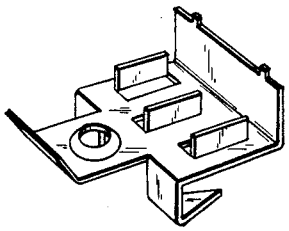
FIGS. 9, 10 and 11 are wall panel attachment clips disclosed in the prior art and comprised of spring steel.
Figure 10:
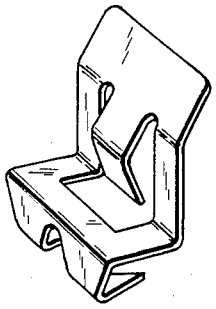
Figure 11:
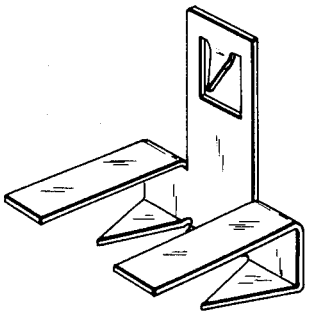

Referring to FIGS. 9, 10 and 11, there are shown panel mounting clips known in the prior art. The impaling points of the prior art clips are about three times the size of the impaling points of the present clips, since the edge clips of the prior art clips are the only means of affixation, while the present clips have impaling points driven into the face of the panel in such relationship that the points on two sides of the clip converge toward each other providing a gripping action which secures the clip to the panel. The large impaling points of the prior art cause core fracture and "pooching".

While the present invention has been disclosed in the light of specific embodiments thereof, it is evident that many alternatives, modifications, and variations may be readily apparent to one skilled in the art in the light of the foregoing description. Accordingly, this disclosure is intended to embrace all such alternatives, modifications and variations as may fall within the spirit and scope of the invention as defined in the following appended claims.

Invention is claimed as follows:

1. An integral clip adapted to attach wall panels having surfaces to supporting studs having flanges adapted to be positoned subjacent and parallel to the surfaces of said wall panels, said clip comprising:

a substantially planar portion adapted to be positioned in immediate juxtaposition with a surface of one of said wall panels to be attached to said flanged stud;

clip members integral with and struck from said planar portion and extending therefrom, a tongue extending at one end of and coplanar with said planar portion and positioned intermediate said clip members, said clip members being generally arcuately formed for receiving and frictionally engaging the flange of said stud and forcing it against said tongue, and impaling point-supporting fingers extending from opposite edges of said planar portion at an obtuse angle thereto and having impaling points at the ends thereof adapted to be impaled into the surface of said panel.

2. A clip according to claim 1, wherein said impaling points are disposed at an acute angle with respect to said fingers.

3. A clip according to claim 2, wherein a central impaling point is struck from said planar portion.

4. A clip according to claim 1 wherein said stud flange attachment clip members each have an up-turned end adapted to facilitate engagement with the flange of a stud.

5. Construction comprising supporting studs having flanges, wall panels having surfaces mounted in engagement with the flanges of said studs, and integral clips attaching said wall panels to the flanges of said studs, said integral clips each comprising;

a substantially planar portion positioned in immediate juxtaposition with the surface of one of said wall panels;

clip members integral with and struck from said planar portion and extending therefrom, a tongue extending from one end of and coplanar with said planar portion positioned intermediate salid clip members, said clip members being generally arcuately formed and receiving and frictionally engaging the flange of said stud and forcing said flange against said tongue, and impaling point-supporting fingers extending from opposite edges of said planar portion at an obtuse angle thereto and having impaling points at the ends thereof impaled into the surface of said panels.

6. Construction according to claim 5, wherein said impaling points are disposed at substantially an acute angle with respect to said fingers.

7. Construction according to claim 6, wherein a central impaling point struck from said planar portion is impaled in said panel.

8. Construction according to claim 5, wherein said stud flange attachment clip members have an up-turned end adapted to facilitate engagement with the flange of said stud.

* * * * *

UNITED STATES PATENT AND TRADEMARK OFFICE

CERTIFICATE OF CORRECTION

PATENT NO. : 4,621,473

DATED : November 11, 1986

INVENTOR(S) : Alan C. Wendt

It is certified that error appears in the above—identified patent and that said Letters Patent is hereby corrected as shown below:

IN THE CLAIMS:

Claim 5, column 8, line 2, change "salid" to --said--.

Signed and Sealed this

Seventeenth Day of March, 1987

*Attest:*

DONALD J. QUIGG

*Attesting Officer*

*Commissioner of Patents and Trademarks*